US010203634B1

(12) United States Patent
Takenaka

(10) Patent No.: US 10,203,634 B1
(45) Date of Patent: Feb. 12, 2019

(54) IMAGE FORMING APPARATUS INCLUDING A TRANSFER ROLLER CLEANER AND IMAGE FORMING METHOD

(71) Applicants: KABUSHIKI KAISHA TOSHIBA, Minato-ku, Tokyo (JP); TOSHIBA TEC KABUSHIKI KAISHA, Shinagawa-ku, Tokyo (JP)

(72) Inventor: Sunao Takenaka, Odawara Kanagawa (JP)

(73) Assignees: KABUSHIKI KAISHA TOSHIBA, Tokyo (JP); TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/709,789

(22) Filed: Sep. 20, 2017

(51) Int. Cl.
*G03G 15/20* (2006.01)
*G03G 15/16* (2006.01)
*G03G 15/00* (2006.01)

(52) U.S. Cl.
CPC ..... *G03G 15/1665* (2013.01); *G03G 15/5029* (2013.01); *G03G 2215/00751* (2013.01)

(58) Field of Classification Search
CPC ..... G03G 15/1665; G03G 15/5029; G03G 2215/00751
See application file for complete search history.

(56) References Cited

U.S. PATENT DOCUMENTS 8,923,712 B1 * 12/2014 Kiuchi ..... G03G 15/0822 399/390
9,746,802 B2 8/2017 Yokoyama

FOREIGN PATENT DOCUMENTS

JP 2003-248360 9/2003
JP 2016-161853 9/2016

* cited by examiner

*Primary Examiner* — Hoang Ngo
(74) *Attorney, Agent, or Firm* — Amin, Turocy & Watson LLP

(57) ABSTRACT

In accordance with an embodiment, an image forming apparatus comprises a printing setting acquisition section and a printer section. The printing setting acquisition section acquires printing setting information for holding setting at the time of printing for each kind of a sheet. The printer section applies, in a case in which a label paper is selected as the kind of the sheet, a developing agent in the vicinity of an area coming into contact with an end part of the sheet in an area on an image carrier for transferring the developing agent to the sheet, transfers the developing agent by a transfer member for transferring the developing agent from the image carrier to the sheet, and rotates the transfer member at least once.

10 Claims, 9 Drawing Sheets

IMAGE FORMING APPARATUS INCLUDING A TRANSFER ROLLER CLEANER AND IMAGE FORMING METHOD

FIELD

Embodiments described herein relate generally to an image forming apparatus and an image forming method.

BACKGROUND

In recent years, various types of media such as a label paper, plastic media such as an OHP, a sheet with the surface of a paper coated, in addition to a normal sheet, is printed in an image forming apparatus.

However, in the case of media including an adhesive layer such as a label paper, if heat and pressure are applied to the media, an adhesive agent of the adhesive layer adheres to an image carrier, a fixing device and a conveyance path. The adhering adhesive agent is not sufficiently removed by a cleaner for removing remaining toner on the image carrier. Thus, there is a case in which cleaning failure occurs, and problems such as conveyance failure and image failure occur.

DETAILED DESCRIPTION

In accordance with an embodiment, an image forming apparatus comprises a printing setting acquisition section and a printer section. The printing setting acquisition section acquires printing setting information for holding setting at the time of printing for each kind of a sheet. The printer section applies, in a case in which a label paper is selected as the kind of the sheet, a developing agent in the vicinity of an area coming into contact with an end part of the sheet in an area on an image carrier for transferring the developing agent to the sheet, transfers the developing agent by a transfer member for transferring the developing agent from the image carrier to the sheet, and rotates the transfer member at least once.

Figure 1:
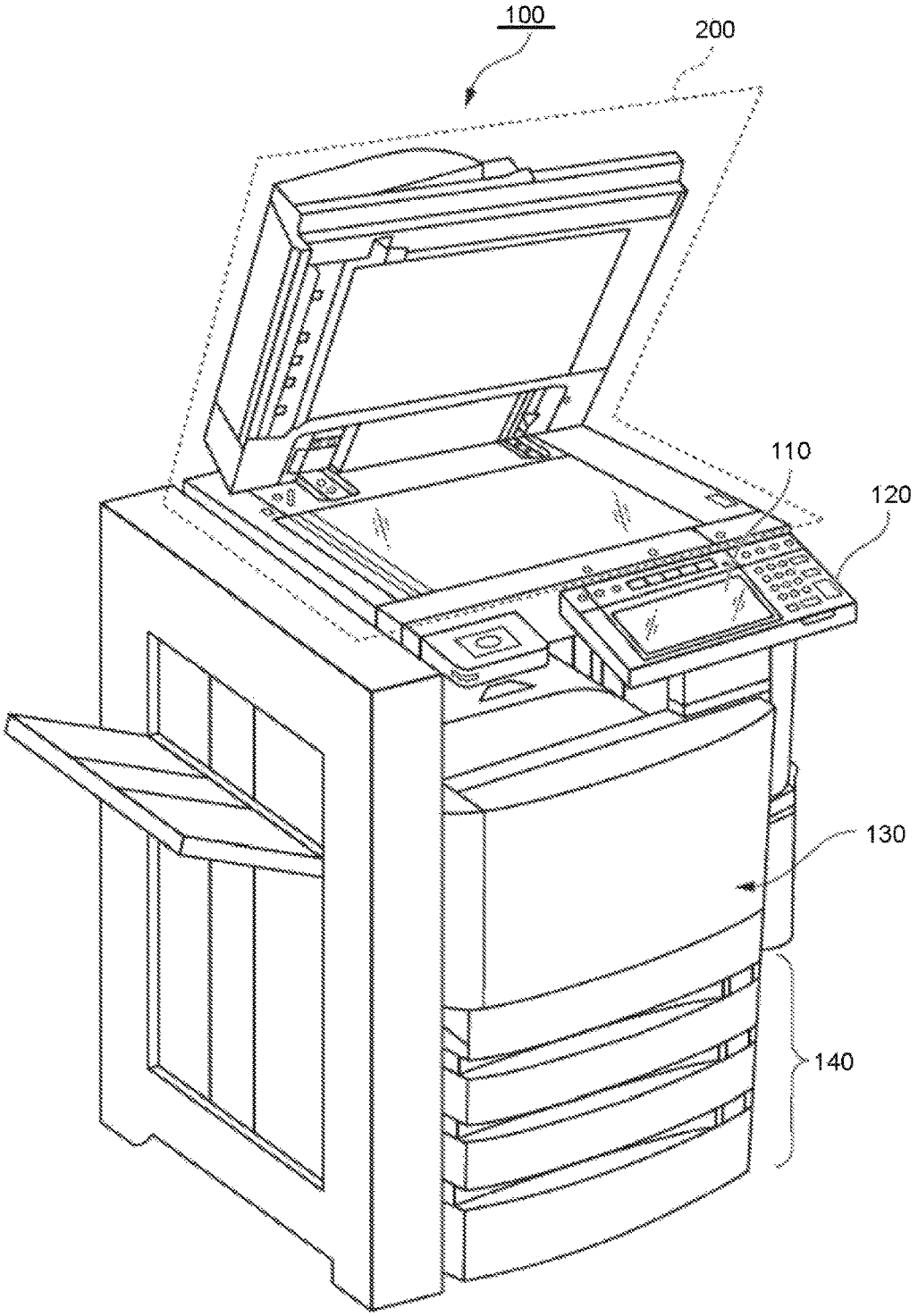
FIG. 1 is an external view illustrating an example of an entire constitution of an image forming apparatus 100 according to an embodiment.

FIG. 1 is an external view illustrating an example of an entire constitution of an image forming apparatus 100 according to an embodiment. The image forming apparatus 100 is, for example, a multi-functional peripheral. The image forming apparatus 100 includes a display 110, a control panel 120, a printer section 130, a sheet housing section 140, and an image reading section 200. Furthermore, the printer section 130 of the image forming apparatus 100 may be a device for fixing a toner image.

The image forming apparatus 100 forms an image on a sheet with a developing agent such as toner. The sheet is, for example, a paper or a label paper. The sheet may be an optional sheet as long as the image forming apparatus 100 can form an image on the surface of the sheet.

The display 110 is an image display device such as a liquid crystal display, an organic EL (Electro Luminescence) display and the like. The display 110 displays various kinds of information relating to the image forming apparatus 100.

The control panel 120 has a plurality of buttons. The control panel 120 receives an operation of a user. The control panel 120 outputs a signal corresponding to an operation carried out by the user to a control section of the image forming apparatus 100. Furthermore, the display 110 and the control panel 120 can be separate or both may be integrated into a single touch panel.

The printer section 130 forms an image on a sheet on the basis of image information generated by the image reading section 200 or image information received via a communication path. The printer section 130 forms the image through, for example, the following processing. The image forming section of the printer section 130 forms an electrostatic latent image on a photoconductive drum 149 on the basis of the image information. The image forming section of the printer section 130 enables a developing agent to adhere to the electrostatic latent image to form a visible image. As a concrete example of the developing agent, toner is exemplified. The transfer section of the printer section 130 transfers the visible image on the sheet. The fixing section of the printer section 130 heats and pressures the sheet to enable the visible image to be fixed on the sheet. Furthermore, the sheet on which the image is formed may be a sheet housed in the sheet housing section 140 or a manually fed sheet.

The sheet housing section 140 houses a sheet used for printing by the printer section 130.

The image reading section 200 reads the image information of a read object as intensity of light. The image reading section 200 records the read image information. The recorded image information may be sent to another information processing apparatus via a network. The recorded image information may be printed on the sheet by the printer section 130.

Figure 2:
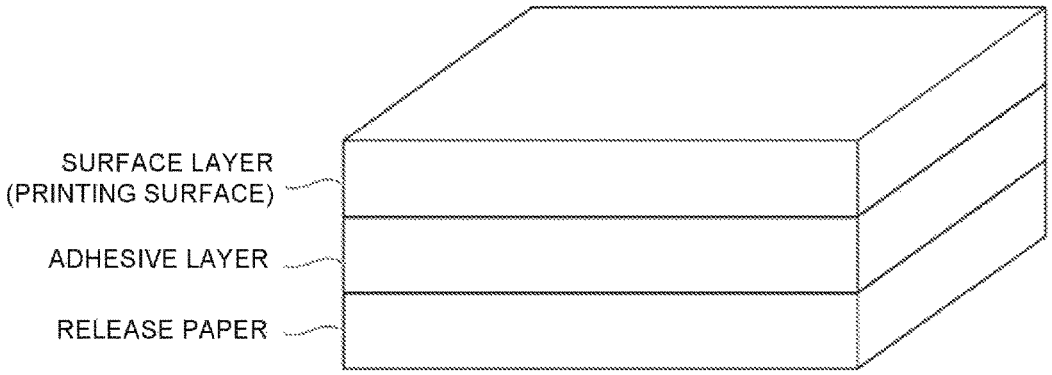
FIG. 2 is a diagram illustrating one concrete example of a constitution of a label paper.

FIG. 2 is a diagram illustrating one concrete example of a constitution of a label paper. The label paper is composed of a release paper, an adhesive layer and a surface layer. The label paper is used by peeling the surface layer and the adhesive layer from the release paper. The adhesive layer is composed of an adhesive agent. The adhesive layer adheres to a substance brought into contact after peeled from the release paper. If pressure is applied to the adhesive layer, there is a case in which the adhesive agent leaks out from an end part. The adhesive agent is composed of, for example, a paste. The surface layer is a printing surface of the label paper.

Figure 3:
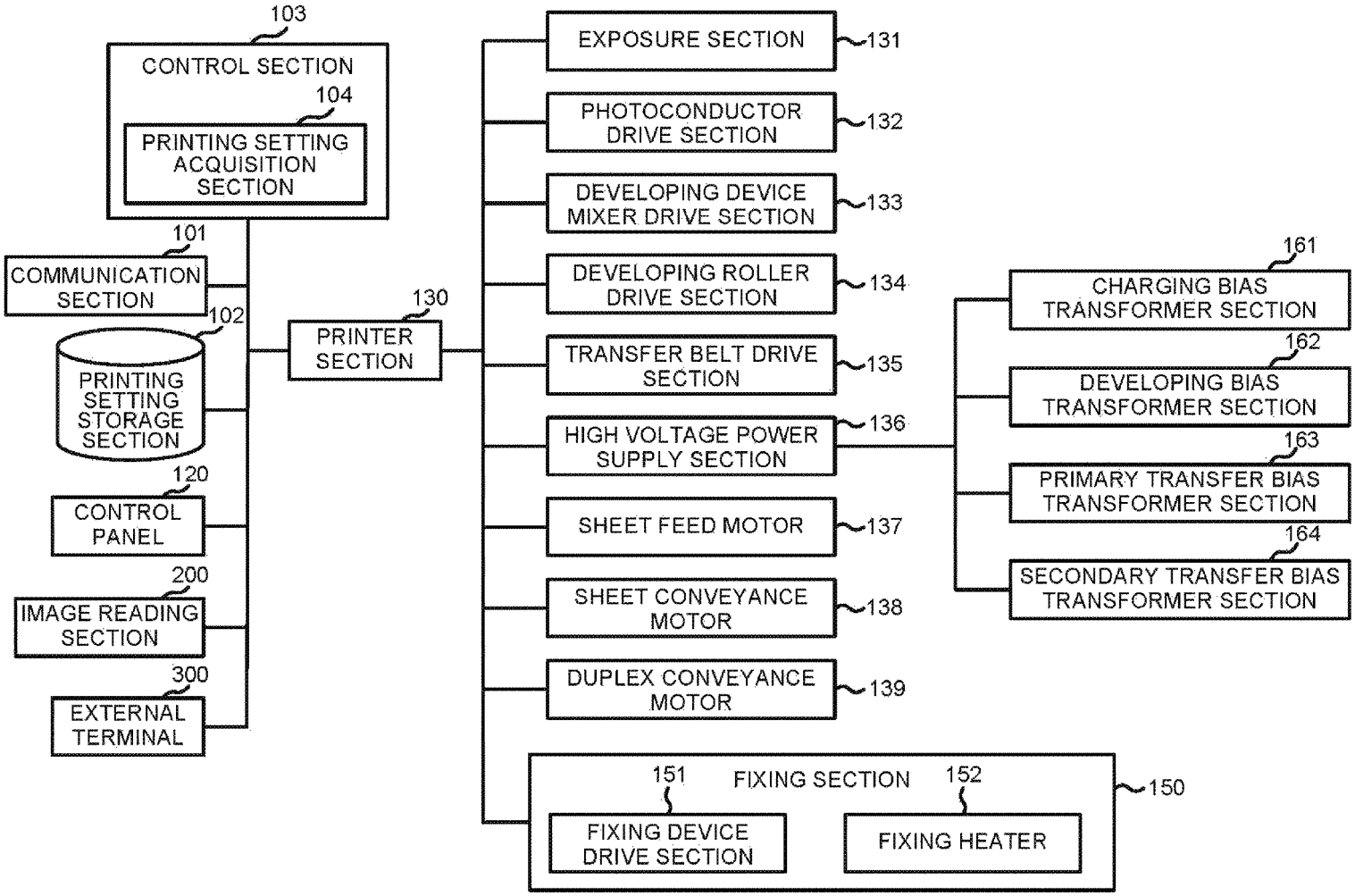
FIG. 3 is a functional block diagram illustrating functional components of the image forming apparatus 100 according to the embodiment.

FIG. 3 is a functional block diagram illustrating functional components of the image forming apparatus 100 according to the embodiment. The image forming apparatus 100 includes a communication section 101, a printing setting storage section 102, a control section 103, the control panel 120, the printer section 130 and the image reading section 200.

The communication section 101 is a network interface. The communication section 101 communicates with an external terminal via a network. The communication section 101 may carry out communication by a communication system, for example, an LAN (Local Area Network), a PSTN (Public Switched Telephone Network) or a NFC (Near Field Communication)

The printing setting storage section 102 is constituted using a storage device such as a magnetic hard disk device or a semiconductor storage device. The printing setting storage section 102 stores printing setting information. The printing setting information holds setting of the printer section 130 in a case in which print media such as sheets and media are printed. The printing setting storage section 102 stores the printing setting information for each of print media. The printing setting information has information, for example, rotational speeds of various rollers, which cassette of the sheet housing section 140 a sheet is acquired from, and the like. In a case in which the printing setting information is information in which print media relate to a label paper, the printing setting information has setting for forming a toner pattern on an end part of the label paper.

The control section 103 controls operations of each section of the image forming apparatus 100. The control section 103 is executed by, for example, a device including a CPU (Central Processing Unit) for controlling the overall device and a RAM (Random Access Memory). The control section 103 functions as a printing setting acquisition section 104 by executing an image forming program.

The printing setting acquisition section 104 acquires, on the basis of instruction information received by the control panel 120, the printing setting information from the printing setting storage section 102. The instruction information includes information (for example, a sheet type and a sheet size) which can specify any printing setting information from a plurality of printing setting information stored in the printing setting storage section 102. The printing setting acquisition section 104 outputs the acquired printing setting information to the printer section 130. The printing setting acquisition section 104 may receive the instruction information from an external terminal 300.

The external terminal 300 is an information processing device such as a personal computer, a tablet computer or a smartphone.

The printer section 130 carries out printing on the basis of the printing setting information. Specifically, the printer section carries out printing by controlling an exposure section 131, a photoconductor drive section 132, a developing device mixer drive section 133, a developing roller drive section 134, a transfer belt drive section 135, a high voltage power supply section 136, a sheet feed motor 137, a sheet conveyance motor 138, a duplex conveyance motor 139 and a fixing section 150.

The exposure section 131 exposes the photoconductive drum 149 by enabling a light emitting element to emit light. The photoconductor drive section 132 rotates the photoconductive drum 149 by driving a motor for the photoconductive drum 149. The developing device mixer drive section 133 rotates a mixer member in the developing device by driving a motor for a developing device 151. The developing roller drive section 134 rotates a developing roller by driving a motor for the developing roller included in the developing device. The transfer belt drive section 135 rotates an intermediate transfer belt 146 by driving a motor for the intermediate transfer belt 146.

The high voltage power supply section 136 applies biases to a charging roller, the developing roller, a primary transfer roller 148 and a secondary transfer counter roller 144. The high voltage power supply section 136 includes a charging bias transformer section 161, a developing bias transformer section 162, a primary transfer bias transformer section 163 and a secondary transfer bias transformer section 164.

The charging bias transformer section 161 applies a bias to the charging roller. The developing bias transformer section 162 applies a bias to the developing roller. The primary transfer bias transformer section 163 applies a bias to the primary transfer roller 148. The secondary transfer bias transformer section 164 applies a bias to the secondary transfer counter roller 144.

The sheet feed motor 137 conveys a sheet from the sheet housing section 140 to the printer section 130. The sheet conveyance motor 138 conveys the sheet conveyed from the sheet housing section 140. The duplex conveyance motor 139 conveys, to the secondary transfer roller 143, the sheet conveyed to the fixing section 150, through an ADU section.

The fixing section 150 fixes toner adhering to the sheet on the sheet through heat and pressure. The fixing section 150 includes a fixing device drive section 151 and a fixing heater 152. The fixing device drive section 151 rotates a heating roller 156 and a pressure roller 157 included in the fixing section 150 by driving motors of the heating roller 156 and the pressure roller 157. The fixing heater 152 is built in the heating roller 156. The fixing heater 152 melts the toner by generating heat.

Figure 4:
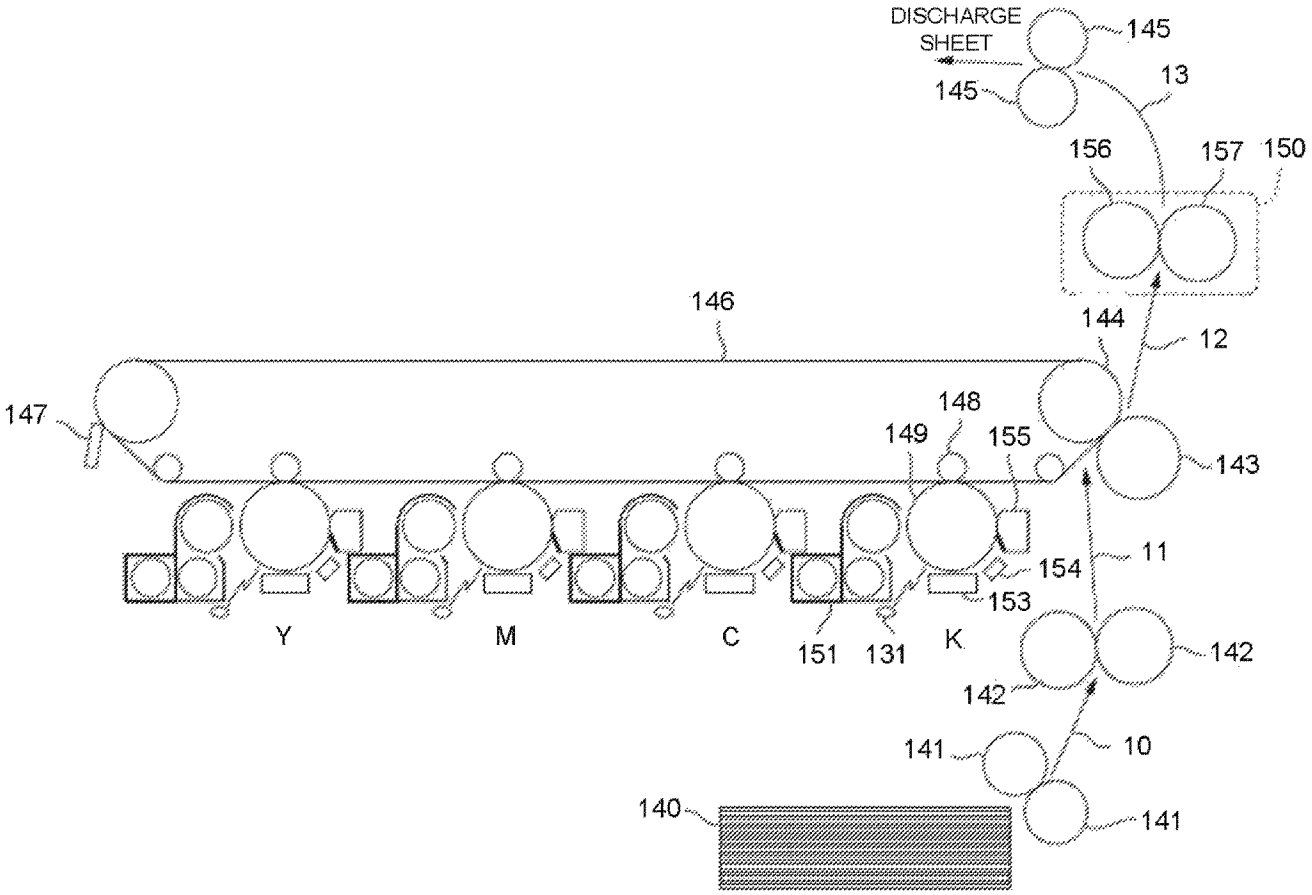
FIG. 4 is a diagram illustrating an inner constitution of a printer section 130 according to the embodiment.

FIG. 4 is a diagram illustrating an inner constitution of the printer section 130 according to the embodiment. The printer section 130 according to the embodiment is the form of a quadruple tandem intermediate system. The printer section 130 includes the exposure section 131, the sheet housing section 140, a sheet feed roller 141, a sheet conveyance roller 142, the secondary transfer roller 143, the secondary transfer counter roller 144, a sheet discharge roller 145, the intermediate transfer belt 146, an intermediate transfer belt cleaner 147, the primary transfer roller 148, the photoconductive drum 149, the fixing section 150, the developing device 151, a charger 153, a charge removing device 154 and a cleaner 155.

Herein, the primary transfer roller 148, the photoconductive drum 149, the developing device 151, the exposure section 131, the charger 153, the charge removing device 154 and the cleaner 155 are disposed for each color of the developing agents. In the present embodiment, the numbers of foregoing components each are four. Hereinafter, the sheet housed in the sheet housing section 140 is described as the label paper.

The label paper housed in the sheet housing section 140 is conveyed to a route 10 by the sheet feed roller 141. The label paper conveyed to the route 10 is conveyed to a route 11 by the sheet conveyance roller 142. The label paper conveyed to the route 11 is conveyed to a route 12 by the secondary transfer roller 143. The label paper conveyed to the route 12 is conveyed to a route 13 by the heating roller 156 and the pressure roller 157 included in the fixing section 150. The label paper conveyed to the route 13 is discharged to outside of the image forming apparatus 100 by the sheet discharge roller 145.

If the label paper is conveyed to the secondary transfer roller 143, the visible image is transferred by the secondary transfer roller 143. The visible image is an image formed on the intermediate transfer belt 146. The visible image also includes a toner pattern also formed in the vicinity of an edge of an end part of the label paper. The visible image formed in the vicinity of the edge of the end part of the label paper is formed in a paper area and a non-paper area. The intermediate transfer belt 146 is one form of an image carrier for transferring the developing agent to the sheet.

There is a case in which the adhesive agent of the label paper leaks out from the end part through the pressure applied from the secondary transfer roller 143. The leaked adhesive agent comes into contact with the developing agent transferred in the vicinity of the edge of the end part of the label paper. The developing agent coming into contact with the adhesive agent reduces adhesive force of the adhesive agent to the intermediate transfer belt 146. Thus, the most of the leaked adhesive agent is conveyed to the fixing section 150 together with the label paper. The developing agent which is not transferred to the label paper and the adhesive agent slightly adhering to the intermediate transfer belt 146 are removed by the intermediate transfer belt cleaner 147.

Figure 5:
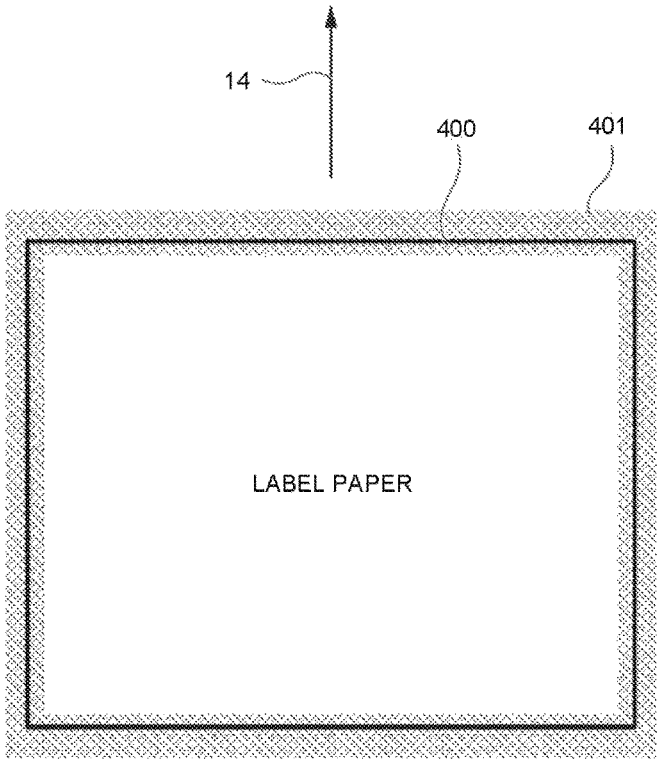
FIG. 5 is a diagram illustrating one concrete example of a visible image formed in the vicinity of an edge of an end part of the label paper according to the embodiment.

FIG. 5 is a diagram illustrating one concrete example of a visible image formed in the vicinity of an edge of an end part of the label paper according to the embodiment. An arrow 14 represents a conveyance direction of a label paper 400. An area 401 covering an end part of the label paper 400 is an area in which a visible image is formed. The visible image is formed in the vicinity of the edge of the end part to which the adhesive agent is easy to leak out. The inner side of the label paper 400 within the area 401 is a paper area. The outer side of the label paper 400 within the area 401 is a non-paper area. The adhesive agent is easy to leak out to the non-paper area of the area 401.

The visible image is printed in the vicinity of the edge of the end part of the label paper 400. Thus, it is desirable that the visible image is printed in a color of the surface layer of the label paper. For example, in a case in which the surface layer of the label paper 400 is blue, the printer section 130 prints the visible image in blue (mixed color of C and M). In a case in which the label paper 400 is a type of label paper which does not use the end part as the label, the printer section 130 may increase the density of the visible image formed in the area 401. The visible image may be formed by a white developing agent, a colorless developing agent or a decoloring developing agent. With such a constitution, even if the developing agent adheres to the end part of the label paper 400, the color can be made inconspicuous. The decoloring developing agent is a developing agent to be decolored through heating.

Figure 6:
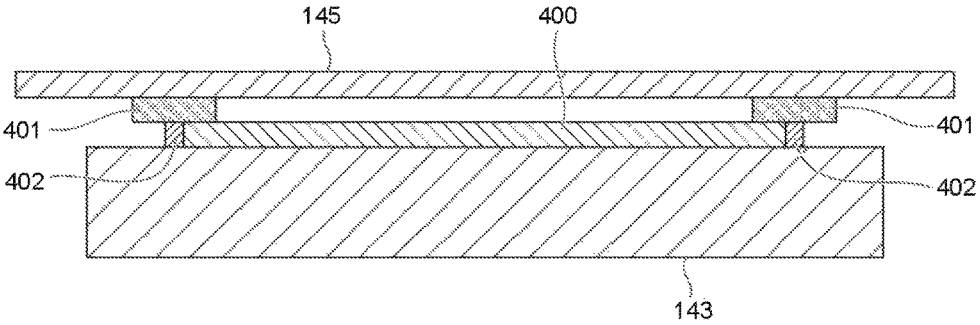
FIG. 6 is a diagram illustrating a positional relationship in a width direction in a case in which portions of both sides of the label paper are secondarily transferred according to the embodiment.

FIG. 6 is a diagram illustrating a positional relationship in a width direction in a case in which portions of both sides of the label paper are secondarily transferred according to the embodiment. An area 401 is an area indicating the developing agent formed on the intermediate transfer belt 146, similar to FIG. 5. An area 402 is an edge portion of an end part of the label paper 400. The area 402 is an area to which the adhesive agent is easy to leak out. With reference to FIG. 6, even if the adhesive agent leaks out from the label paper 400 to the area 402 through the pressure of the secondary transfer roller 143, the adhesive agent does not adhere to the intermediate transfer belt 146 since the developing agent adhering to the area 401 is shielded.

Figure 7:
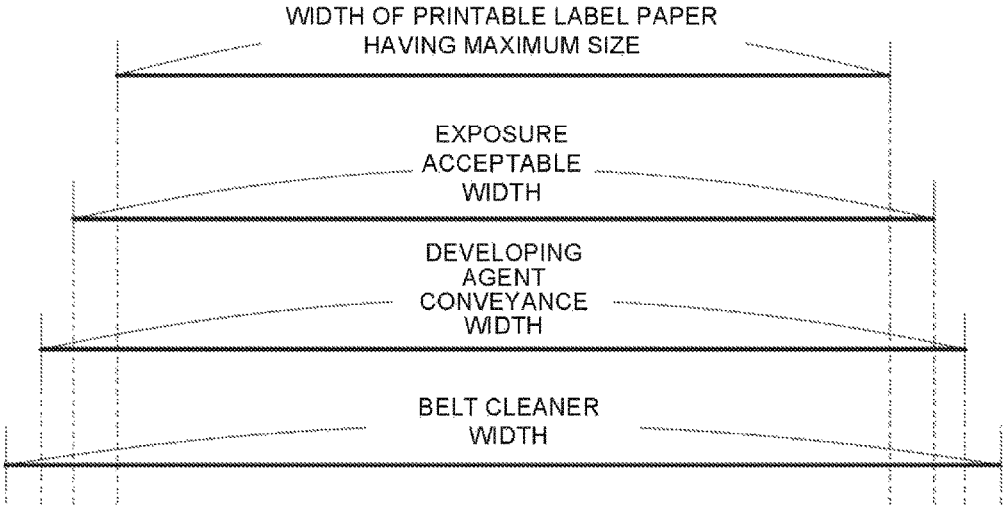
FIG. 7 is a diagram illustrating one concrete example of a relationship between lengths of widths of respective members according to the embodiment.

FIG. 7 is a diagram illustrating one concrete example of a relationship between lengths of widths of respective members according to the embodiment. A width of a printable label paper having a maximum size is a width of the largest label paper that can be printed by the image forming apparatus. An exposure acceptable width is a width of exposure to the photoconductive drum 149 by the exposure section 131. It is desirable that the exposure acceptable width is longer than the width of the label paper such that the visible image is formed up to the non-paper area of the label paper.

A developing agent conveyance width is a width capable of forming the visible image on the intermediate transfer belt 146 by the developing agent. It is desirable that the developing agent conveyance width is longer than the exposure acceptable width such that the visible image is also formed in the exposed non-paper area. A belt cleaner width is a width of the intermediate transfer belt cleaner 147 for removing the developing agent left on the intermediate transfer belt 146. It is desirable that the belt cleaner width is longer than the developing agent conveyance width such that the developing agent on the intermediate transfer belt 146 is removed.

Figure 8:
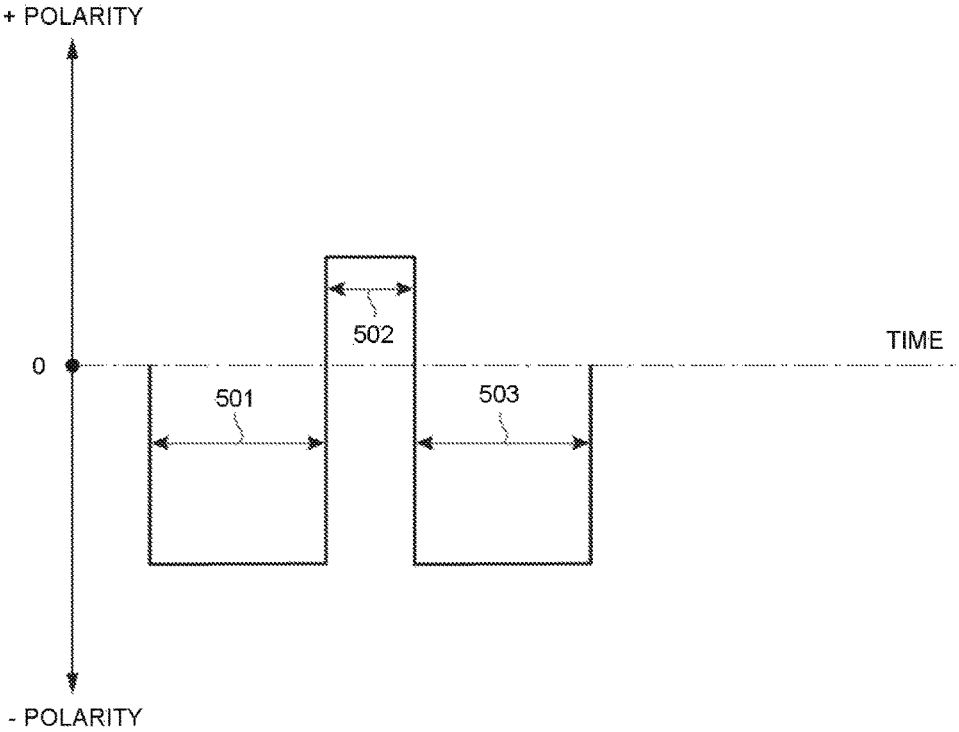
FIG. 8 is a diagram illustrating one concrete example of bias application to a secondary transfer counter roller 144 according to the embodiment.

FIG. 8 is a diagram illustrating one concrete example of bias application to the secondary transfer counter roller 144 according to the embodiment. If the visible image is formed in the non-paper area, there is a case in which the developing agent adheres to the secondary transfer roller 143. If the developing agent adheres to the secondary transfer roller 143, there is a possibility that the developing agent adheres to the back surface of a subsequent sheet next time. A module for preventing that the developing agent adheres to the back surface of the sheet is described with reference to FIG. 8. The vertical axis represents a polarity of a bias applied to the secondary transfer counter roller 144. The horizontal axis represents passage of time.

In a case in which the value of the vertical axis is smaller than 0, a bias of a negative polarity is applied to the secondary transfer counter roller 144. The negative polarity is the same polarity as the developing agent charged quantity. Thus, the developing agent adhering to the intermediate transfer belt 146 repels against the intermediate transfer belt 146, and adheres to the label paper 400.

In a case in which the value of the vertical axis is greater than 0, a bias of a positive polarity is applied to the secondary transfer counter roller 144. The positive polarity is an opposite polarity to the developing agent charged quantity. Thus, the developing agent adhering to the secondary transfer roller 143 is attracted to the secondary transfer counter roller 144, and adheres to the intermediate transfer belt 146.

An arrow 501 represents a length of time when the developing agent is transferred to the label paper. The secondary transfer counter roller 144 is applied with the bias of the negative polarity only corresponding to the time shown by the arrow 501. The developing agent is transferred from the intermediate transfer belt 146 to the label paper at the time the bias of the negative polarity is applied.

An arrow 502 represents a length of time when the secondary transfer roller 143 is rotated at least one or more times. The secondary transfer counter roller 144 is applied with the positive polarity bias only for the time shown by the arrow 502. The developing agent moves from the secondary transfer roller 143 to the intermediate transfer belt 146 at the time the positive polarity bias is applied. Since the secondary transfer roller 143 is rotated at least one or more times, the developing agent adhering to the whole surface of the secondary transfer roller 143 can move to the intermediate transfer belt 146. Thus, the developing agent adhering to the secondary transfer roller 143 can be prevented from adhering to the back surface of the sheet to be printed subsequently.

An arrow 503 represents a length of time when the developing agent is transferred to the next label paper. The secondary transfer counter roller 144 is applied with the bias of the negative polarity only for the time shown by the arrow 503. The developing agent is transferred from the intermediate transfer belt 146 to the label paper at the time the bias of the negative polarity is applied.

Figure 9:
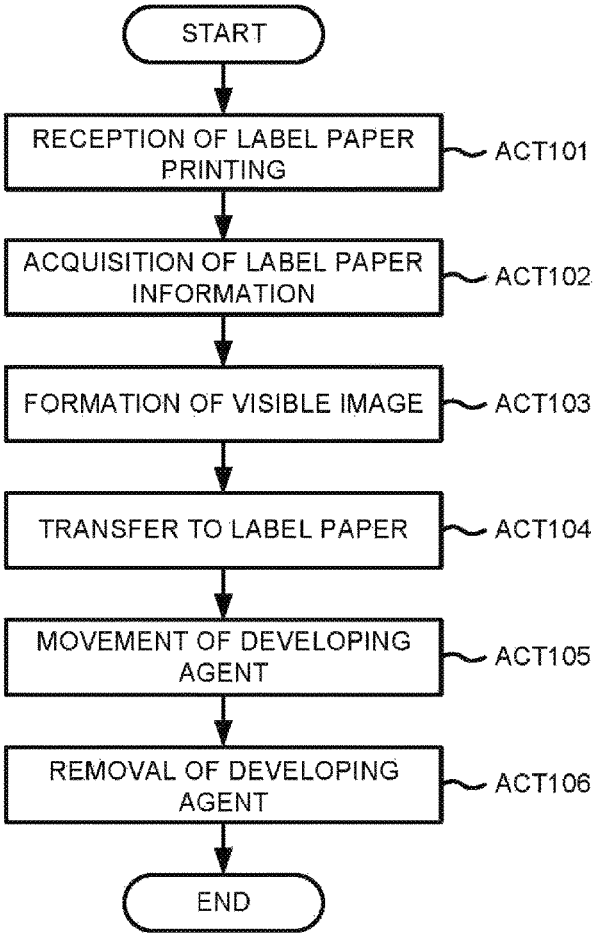
FIG. 9 is a flowchart illustrating cleaning of a secondary transfer roller 143 according to the embodiment.

FIG. 9 is a flowchart illustrating cleaning of the secondary transfer roller 143 according to the embodiment. The printing setting acquisition section 104 of the image forming apparatus receives an instruction of label paper printing from a user via the control panel 120 (ACT 101). The printing setting acquisition section 104 acquires printing setting information relating to the label paper printing from the printing setting storage section 102 (ACT 102). The printer section 130 of the image forming apparatus 100 forms a visible image on the intermediate transfer belt 146 on the basis of the printing setting information relating to the label paper printing (ACT 103). At this time, the printer section 130 forms a visible image on an edge portion of an end part of the label paper, in addition to the visible image of the image received from the user.

The label paper is pressured by the secondary transfer roller 143 and the secondary transfer counter roller 144 such that the visible image on the intermediate transfer belt 146 is transferred to the label paper (ACT 104). At this time, there is a case in which the developing agent adheres to the secondary transfer roller 143.

The developing agent adhering to the secondary transfer roller 143 moves to the intermediate transfer belt 146 (ACT 105). Specifically, the secondary transfer bias transformer section 164 applies the bias of the positive polarity to the secondary transfer counter roller 144. The secondary transfer counter roller 144 attracts the developing agent adhering to the secondary transfer roller 143, and enables the developing agent to adhere to the intermediate transfer belt 146. The intermediate transfer belt cleaner 147 removes the developing agent adhering to the intermediate transfer belt 146 (ACT 106).

In the image forming apparatus 100 constituted in this way, the visible image is formed in the non-paper area of the edge portion of the end part of the label paper 400. The adhesive force of the adhesive agent leaked out from the label paper 400 is reduced by the visible image. Thus, the adhesive agent can be prevented from adhering to the intermediate transfer belt 146. Further, by adding the developing agent added to the edge portion of the end part of the label paper 400, such as the white developing agent, the colorless developing agent or the decoloring developing agent, even if the surface layer of the label paper 400 is white, the visible image can be made inconspicuous. Moreover, after the label paper is printed, the developing agent adhering to the intermediate transfer belt 146 can be removed by applying the bias of the positive polarity to the secondary transfer counter roller 144. Thus, the developing agent adhering to the secondary transfer roller 143 can be prevented from adhering to the back surface of the sheet to be printed subsequently.

(Modification)

Figure 10:
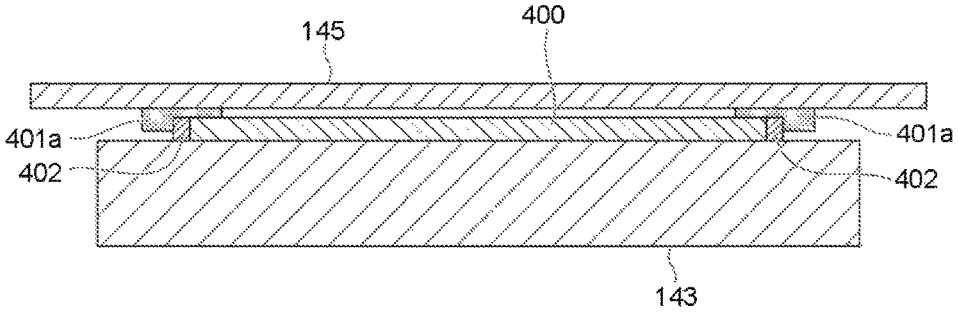
FIG. 10 is a diagram illustrating one concrete example in which a halftone visible image is formed on an end part of the label paper according to the embodiment.

FIG. 10 is a diagram illustrating one concrete example in which a halftone visible image is formed on the end part of the label paper according to the embodiment. An area 401*a* is an area indicating the developing agent formed on the intermediate transfer belt 146. An amount (like halftone) of the developing agent of the paper area coming into contact with the label paper 400 in the area 401*a* may be less than that of the non-paper area. With such a constitution, even if the mixed color is not used such that the surface layer of the label paper 400 is white, the visible image of the edge portion of the end part of the label paper 400 can be made inconspicuous. Furthermore, in a case in which the surface layer of the label paper 400 is white, it is desirable to form the visible image with inconspicuous yellow toner. However, in the case of the image forming apparatus in which the yellow toner cannot be used, a thin halftone visible image may be used in the paper area.

Figure 11:
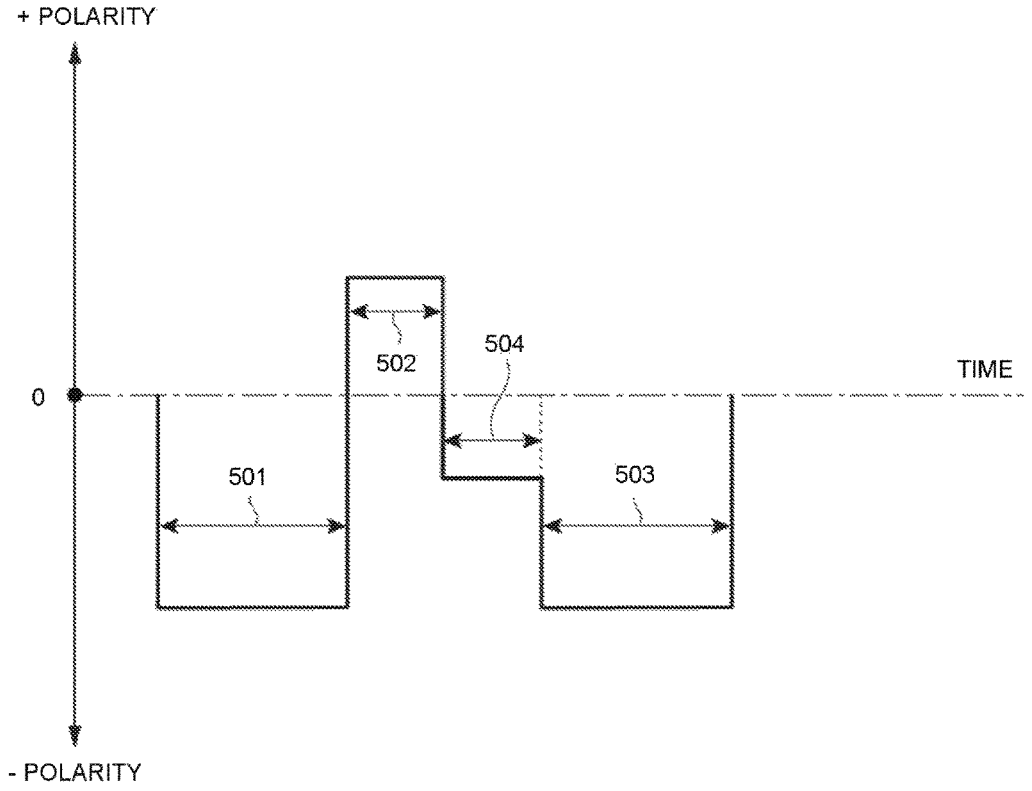
FIG. 11 is a diagram illustrating one concrete example of bias application in a case in which toner charged to a positive polarity is removed according to the embodiment.

FIG. 11 is a diagram illustrating one concrete example of bias application in a case in which toner charged to the positive polarity is removed according to the embodiment. The developing agent is charged to the negative polarity in most cases. However, according to the use condition of the developing agent, there is a case in which a part of the developing agent is charged to the positive polarity. The developing agent charged to the positive polarity cannot move from the secondary transfer roller 143 to the intermediate transfer belt 146 in the method described in FIG. 8.

Herein, in FIG. 11, a method for changing the bias applied to the secondary transfer roller 143 is changed alternately at a predetermined time. Herein, the predetermined time is time when the secondary transfer roller 143 is rotated at least one or more times. The vertical axis represents a polarity of a bias applied to the secondary transfer counter roller 144. The horizontal axis represents passage of time. Points different from FIG. 8 are described.

An arrow 504 represents time when the developing agent of the positive polarity moves from the secondary transfer roller 143 to the intermediate transfer belt 146. A length of the time represented by the arrow 504 represents a length of time when the secondary transfer roller 143 is rotated at least one or more times. The secondary transfer counter roller 144 is applied with the bias of the negative polarity only for the time shown by the arrow 504. The developing agent of the positive polarity moves from the secondary transfer roller 143 to the intermediate transfer belt 146 at the time the bias of the negative polarity is applied. Since the secondary transfer roller 143 is rotated at least one or more times, the developing agent of the positive polarity adhering to the whole surface of the secondary transfer roller 143 can move to the intermediate transfer belt 146. With such a constitution, the developing agent adhering to the secondary transfer roller 143 moves to the intermediate transfer belt 146, and thus can be prevented from adhering to the back surface of the sheet to be printed subsequently.

Further, the image forming apparatus 100 may be constituted such that a cleaning blade abuts against the secondary transfer roller 143. With such a constitution, the developing agent adhering to the secondary transfer roller 143 can be removed more certainly, and can be prevented from adhering to the back surface of the sheet to be printed subsequently.

Figure 12:
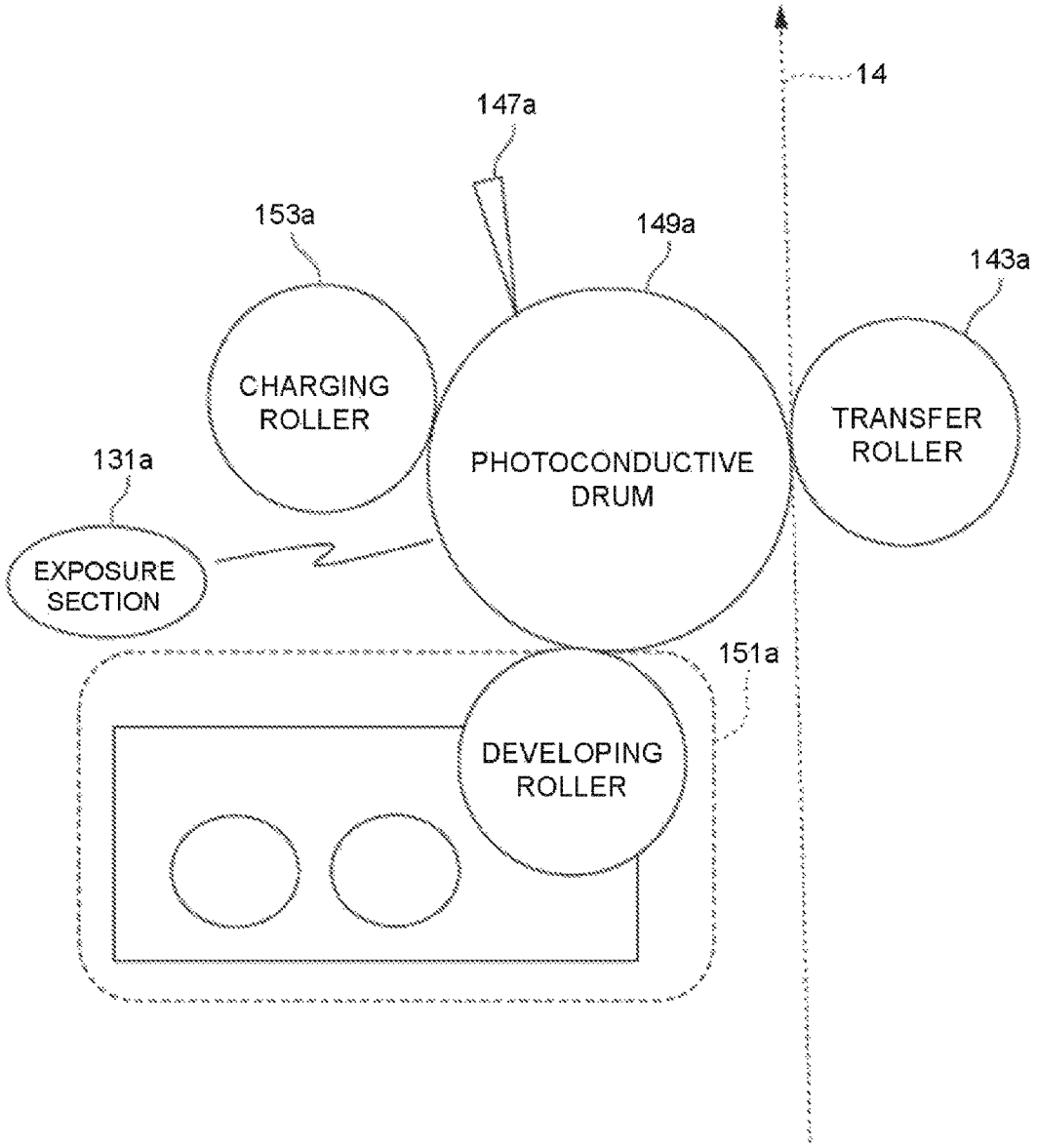
FIG. 12 is a diagram illustrating one concrete example of an inner constitution of a printer section of a monochrome image forming apparatus.

The present embodiment has a printer section as shown in FIG. 12, and may be applied to a monochrome image forming apparatus. The printer section of the monochrome image forming apparatus includes an exposure section 131*a*, a transfer roller 143*a*, a cleaning blade 147*a*, a photoconductive drum 149*a*, a developing device 151*a* and a charging roller 153*a*. An arrow 14 is a conveyance direction of a label paper. In the monochrome image forming apparatus, the exposure section 131*a* functions as the exposure section 131 according to the embodiment. In the monochrome image forming apparatus, the transfer roller 143*a* functions as the secondary transfer roller 143 according to the embodiment. In the monochrome image forming apparatus, the cleaning blade 147*a* functions as the intermediate transfer belt cleaner 147 according to the embodiment. In the monochrome image forming apparatus, the photoconductive drum 149*a* functions as the intermediate transfer belt 146 and the secondary transfer counter roller 144 according to the embodiment. However, the monochrome image forming apparatus cannot apply a transfer bias from the photoconductive drum 149*a* side. In this case, the monochrome image forming apparatus applies the transfer bias having the opposite polarity to a charged polarity of the developing agent from the transfer roller 143*a* side and transfers the visible image to the label paper. In the monochrome image forming apparatus, the developing device 151*a* functions as the developing device 151 according to the embodiment.

In the monochrome image forming apparatus, the visible image formed on an edge portion of an end part of the label paper adheres to the transfer roller 143*a*. Thus, the developing agent can move from the transfer roller 143*a* to the photoconductive drum 149*a* by applying a bias of a cleaning polarity to the transfer roller 143*a*. The cleaning polarity is the same polarity as the charged polarity of the developing agent. The developing agent adhering to the photoconductive drum 149*a* is removed by the cleaning blade 147*a*.

With such a constitution, the developing agent adhering to the transfer roller 143*a* can be prevented from adhering to the back surface of the sheet to be printed subsequently.

While certain embodiments have been described these embodiments have been presented by way of example only, and are not intended to limit the scope of the inventions. Indeed, the novel embodiments described herein may be embodied in a variety of other forms: furthermore various omissions, substitutions and changes in the form of the embodiments described herein may be made without departing from the spirit of the inventions. The accompanying claims and their equivalents are intended to cover such forms or modifications as would fall within the scope and spirit of the invention.

What is claimed is:

1. An image forming apparatus, comprising:

a printing setting acquisition section configured to acquire printing setting information for each kind of a sheet; and a printer section comprising an image carrier configured to hold a developing agent, a transfer member configured to transfer the developing agent from the image carrier to the sheet wherein, the printer section configured to supply the developing agent with the image carrier in the vicinity of an area coming into contact with an end part of the sheet according to the printing setting information, and rotate the transfer member at least once during an interval between transferring the developing agent to the sheet and transferring the developing agent to a second sheet, thereby cleaning the transfer member before transferring the developing agent to the second sheet, in a case in which a label paper is selected as the kind of the sheet.

2. The image forming apparatus according to claim 1, wherein the printer section transfers the developing agent to a sheet, and applies a bias in an opposite direction to that when the transfer member transfers the developing agent to the sheet to rotate the transfer member at least once.

3. The image forming apparatus according to claim 1, wherein the printer section transfers the developing agent to a sheet, applies a bias in an opposite direction to that when the transfer member transfers the developing agent to the sheet to rotate the transfer member at least once, and further applies a bias in the same direction as that when the transfer member transfers the developing agent to the sheet to rotate the transfer member at least once.

4. An image forming apparatus, comprising:

a printing setting acquisition section configured to acquire printing setting information for each kind of a sheet; and a printer section comprising an image carrier configured to hold a developing agent, a transfer member configured to transfer the developing agent from the image carrier to the sheet wherein, the printer section configured to supply the developing agent with the image carrier in the vicinity of an area coming into contact with an end part of the sheet according to the printing setting information, and rotate the transfer member at least once, in a case in which a label paper is selected as the kind of the sheet, and the printer section adds a smaller amount of developing agent than an area beyond the sheet to an area at least within the sheet in the vicinity of the area on the image carrier coming into contact with the end part of the sheet.

5. The image forming apparatus according to claim 4, wherein the printer section adds a developing agent such that a halftone visible image is formed in the area within the sheet in the vicinity of the area on the image carrier coming into contact with the end part of the sheet.

6. The image forming apparatus according to claim 5, wherein the printer section adds a developing agent having the same color as a color of a surface layer of the sheet in the vicinity of the area coming into contact with the end part of the sheet.

7. The image forming apparatus according to claim 5, wherein the printer section adds one of a yellow developing agent, a white developing agent, a colorless developing agent or a black developing agent to the area on the image carrier coming into contact with the end part of the sheet.

8. The image forming apparatus according to claim 5, wherein the printer section adds a developing agent to be decolored through heating to the area on the image carrier coming into contact with the end part of the sheet.

9. The image forming apparatus according to claim 1, wherein the image carrier at least has an image forming width having a larger width than a maximum width of a sheet to be printed.

10. An image forming method, comprising:

acquiring, by an image forming apparatus, printing setting information for each kind of a sheet; and supplying a developing agent with an image carrier in the vicinity of an area coming into contact with an end part of the sheet, transferring the developing agent by a transfer member to transfer the developing agent from the image carrier to the sheet, and rotating the transfer member at least once during an interval between transferring the developing agent to the sheet and transferring the developing agent to a second sheet, thereby cleaning the transfer member before transferring the developing agent to the second sheet, by the image forming apparatus in a case in which a label paper is selected as the kind of the sheet.

* * * * *